US009701465B2

(12) United States Patent
Llopez-Miguel et al.

(10) Patent No.: US 9,701,465 B2
(45) Date of Patent: Jul. 11, 2017

(54) FLUIDIZING SYSTEM FOR LINER-BAGS TRANSPORTING DRY SOLID BULK COMMODITIES IN SHIPPING CONTAINER

(71) Applicant: D&BD Marketing LLC, Houston, TX (US)

(72) Inventors: Pablo Llopez-Miguel, Houston, TX (US); Oswaldo Mino, Houston, TX (US)

(73) Assignee: D&BD Marketing, LLC, Houston, TX (US)

( * ) Notice: Subject to any disclaimer, the term of this patent is extended or adjusted under 35 U.S.C. 154(b) by 0 days.

(21) Appl. No.: 15/158,728

(22) Filed: May 19, 2016

(65) Prior Publication Data

US 2016/0264353 A1 Sep. 15, 2016

Related U.S. Application Data

(63) Continuation-in-part of application No. 14/121,474, filed on Sep. 10, 2014.

(60) Provisional application No. 61/960,701, filed on Sep. 25, 2013.

(51) Int. Cl.
*B65D 88/72* (2006.01)
*B65D 90/04* (2006.01)

(52) U.S. Cl.
CPC ..... *B65D 88/72* (2013.01); *B65D 90/046* (2013.01); *B65D 2590/046* (2013.01); *Y10T 137/85938* (2015.04)

(58) Field of Classification Search
CPC ..... B65D 88/72; B65D 90/046
USPC ..... 220/1.6; 229/117.27; 406/39, 89, 122
See application file for complete search history.

(56) References Cited

U.S. PATENT DOCUMENTS 2,805,896 A 9/1957 Yellott
3,170,600 A * 2/1965 Pierson ..... B65D 25/16 222/195
4,896,706 A * 1/1990 Tanner ..... B65D 88/72 141/10

(Continued)

FOREIGN PATENT DOCUMENTS

CN 1835882 10/2010

OTHER PUBLICATIONS

Official Action for CN201010003638 dated Jan. 21, 2012 with translation.
Official Action for CN201010003638 dated Nov. 5, 2012.

*Primary Examiner* — Joseph Dillon, Jr.
(74) *Attorney, Agent, or Firm* — Parks & Associates, PC

(57) ABSTRACT

A dry bulk commodities cargo fluidizing system which is substantially flat and foldable for use in shipping container liner-bags used for transporting bulk commodities and may be built into or secured to liner-bags. The system is composed of a first floor layer and a second floor layer which covers the first floor layer. The first and second floor layers are thermally joined together about woven plastic mesh to form connected chambers for receiving deliver of fluid evenly throughout the system with the second floor layer having multiple pinholes of various size and number density over its surface in relation to the fluid source to the system. The plastic mesh strips between the first and second floor layers create fluid flow bridges for fluid flow even when bulk commodities cargo is loaded onto the second floor layer and is pressing the second floor layer against the first floor layer.

11 Claims, 8 Drawing Sheets

(56) References Cited

U.S. PATENT DOCUMENTS 5,040,693 A * 8/1991 Podd, Sr. ..... B65D 88/72 206/403
5,199,826 A * 4/1993 Lawrence ..... B60P 1/60 406/137
5,547,331 A * 8/1996 Podd ..... B60P 1/60 141/10
5,562,369 A * 10/1996 Jones ..... B65D 88/72 406/90
6,769,571 B2 * 8/2004 Mino ..... B60P 3/2245 220/1.6
6,837,391 B2 * 1/2005 Mino ..... B65D 90/046 220/1.6
7,448,831 B2 * 11/2008 Brown ..... B65D 88/72 406/135
7,597,525 B2 * 10/2009 McMahon ..... B65D 90/046 141/65
8,083,412 B2 * 12/2011 Mino ..... B65D 90/048 220/1.6
8,690,021 B2 * 4/2014 Asraf ..... B65D 88/72 220/1.6
8,714,820 B2 * 5/2014 Mino ..... B65D 90/048 220/1.6
9,193,523 B2 * 11/2015 Mino ..... B65D 90/048
2002/0136608 A1 * 9/2002 Eckel ..... B65D 88/72 406/39
2003/0197009 A1 * 10/2003 Mino ..... B65D 90/046 220/1.6
2004/0020937 A1 * 2/2004 Mino ..... B60P 3/2245 222/1
2004/0035864 A1 * 2/2004 Mino ..... B65D 90/046 220/1.6
2005/0207878 A1 * 9/2005 McMahon ..... B65D 90/046 414/467
2007/0024078 A1 * 2/2007 Mino ..... B60R 13/01 296/39.1
2007/0048113 A1 * 3/2007 McMahon ..... B65D 90/046 414/467
2007/0267410 A1 * 11/2007 Mino ..... B65D 90/048 220/1.6
2009/0159652 A1 * 6/2009 Mino ..... B65D 90/048 229/117.27
2011/0198368 A1 * 8/2011 Asraf ..... B65D 88/72 222/1
2012/0048847 A1 * 3/2012 Mino ..... B65D 90/048 220/1.6

* cited by examiner

FLUIDIZING SYSTEM FOR LINER-BAGS TRANSPORTING DRY SOLID BULK COMMODITIES IN SHIPPING CONTAINER

RELATED APPLICATION

This application is a continuation-in-part of U.S. patent application Ser. No. 14/121,474 filed on 10 Sep. 2014 entitled "Built-In Flat Fluidizing System for Liner-Bags Transporting Hard-to-Flow Dry Solid Bulk Commodities in Marine Shipping Container or Other Freight Type Containers," which claims priority from U.S. Provisional Application No. 61/960,701 filed on 25 Sep. 2013 and entitled "Built-In Flat Fluidizing System For Liner-Bags Transporting Hard-To-Flow Dry Solid Bulk Commodities in Marine Shipping Container Or Other Freight Type Containers", the entire contents of which are hereby fully incorporated herein.

FIELD OF THE INVENTION

The invented subject matter relates to dry bulk commodities cargo fluidizing systems which are substantially flat and foldable for use in flexible shipping container liner-bags used for transporting bulk commodities, such as dry granular products and for the use of such cargo fluidizing systems to aid in the unloading of the dry granular products from the flexible liner-bags for containers.

BACKGROUND OF THE INVENTION

As the use of marine containers or other cargo container which are internally lined with bags, becomes more common for the transportation of dry flowable bulk products, as an alternative to the transportation in bulk vessels, the number and types of bulk products being transported in such marine containers is also growing. These bulk type products now include chemicals, minerals, agricultural and many other varied bulk products.

Such a variety of bulk products need to be matched with an appropriate bulk packaging format able not only to contain the product inside of the marine container for transportation, but also facilitate its loading and unloading. Container liner-bags fulfill that task, as they are flexible bags made of plastic laminated woven or film material, typically polyethylene, that once hung inside of the container, they occupy the full cargo volume inside of the marine or other type container, and they allow for the loading, transportation and unloading of any dry flowable bulk product.

Therefore, the design of the marine and other container liner-bag will vary depending on the methodology or equipment used by the shipper to load its bulk product into the marine or other containers, and the methodology or equipment used by the receiver of the bulk cargo to unload it from the marine or other containers.

Another crucial factor in the design of a marine or other container liner-bags will be the material characteristics of the bulk product itself which includes density, bulk density, angle of repose, hygroscopicity, physical aspect, temperature, and other physical attributes of the bulk product. All these physical characteristics determine how easy or difficult it is for the product to be handled when loading or unloading. Dry bulk products that are easy to handle flow easily into and out of the container liner-bag. Examples of easy to flow products are plastic resins in pellet form, dry whole grains and in general any material of grain or pellet nature. Dry bulk products that are difficult to handle flow poorly.

Examples of hard to flow products are cement, titanium dioxide, starches and in general most powder type products.

In general, product compaction is a big problem and it is typically a function of the angle of repose of the bulk product, the attrition and rheology of its particles, humidity absorption tendency, and the degree of settling of the product inside of the liner-bag over the transportation journey.

These hard-to-flow bulk products in particular pose a real challenge to their transportation in marine container liner-bags when it is time to unload these bulk products. Their handling is especially difficult due to their very poor flow properties and the inherent settling over time during transportation. This difficulty results in the product compacting inside of the container, and it may only be dischargeable by manual removal, instead of the typical gravity method of tilting the container to a maximum of 45° to effectively pour the product out of the container.

Although, air fluidization is not the solution to all products' flow issues (for instance bulk commodities exhibiting bridging or tunneling do not respond to pneumatic fluidization), it is the most prevalent solution for most hard to flow bulk commodities, and even in those cases where the bulk commodity is not sensitive to pneumatic fluidization, it can be used in combination with other type of fluidization (shaking, vibrating, etc.) that renders or assists the pneumatic fluidization to be additively effective as well.

Many devices exist to aid in the fluidization of these products, outside of the container liner-bag, and typically they were applied at the discharge port or door side of the liner-bag. These devices included fluidizing lances, fluidizing, hoppers, de-compacting hoppers with built-in conveyors, industrial vibrators, shaking platforms, and very often even a combination of some of these devices into one for aiding in the fluidization of the product during unloading. However, a comprehensive and systemic solution to fluidization of these products, requires the creation of a fluidization bed inside of the container liner-bag as well for even transmission of the fluid throughout the container liner-bag, into these products in the container.

One of the most prevalent methods to create an airbed for fluidizing the product inside of the container liner-bag, consists of insetting on top of the floor panel of the liner-bag, a perforated plastic hose evenly distributed across the width and length of the liner-bag in an S-shaped pattern. The two ends of the hose are kept outside of the liner-bag, and pressurized air is injected through them to provide continuous air flow that escapes through the small perforations of the hose. As the air escapes through the minute holes into the container liner-bag interior, it creates (in theory) a continuous stream of aeration that as it trickles up through the product, it eventually achieves the desired fluidization of the bulk product in direct contact with these air jets and then through the rest of the bulk product.

Although this method in theory is effective at creating an airbed, its use in practice has numerous shortcomings. One such shortcoming is that as the product is removed from the container at the front end of the container, the air hose starts to become exposed on the front end of the container. As a growing percentage of the injected air just escapes from the exposed front end parts of the hose, the airbed increasingly loses its effectiveness; and the perforated hose across the floor of the container eventually becomes a barrier itself to the outflow of the product, as the container is tilted to 45'.

Because the air hose ends up becoming, a barrier to the product's outflow, the product starts dragging down on the liner and the perforated hose, which ends up jammed down on the back end of the container and the airbed is rendered almost useless. An attempted solution to this problem, has been to affix the perforated hose to the floor so as to prevent its movement, but in many instances this results in the liner floor of the container bag being torn by the effect of the product pulling down on the fixed hose which is attached to the liner floor.

The S-shaped air hoses are also often bent or pinched, and therefore rendered useless, when the container liner-bag is folded and unfolded, due to the nature of the packing process that requires the liner-bag and air hoses to be folded and unfolded together numerous times in their process of use.

BRIEF DESCRIPTION OF THE INVENTION

The subject of this invention relates to a substantially flat and non-interfering fluidizing system, which in some embodiment is formed into an airbed like structure, built as a second floor, into or from the liner-bag's floor, that has the capability of injecting air as a fluid across the maximum surface of the container floor in contact with the product in the container liner-bag and at a higher density of flow levels than current prevailing systems. This invention therefore creates more uniform and powerful fluidization effects. In this invention there is also provided in some embodiments spacers or interface members which prevents the weight of the product on the second floor from cutting off the flow of the air fluidizer from flowing to all parts of the fluidizing system at relatively even pressure. Also, in the initialization of the air fluidization into the airbed like structure there is some very slight upward movement of the second for as the pressure of the system is raised, which has the effect of moving or breaking up the bulk cargo at the surface interface of the second floor just slightly. Though the moving or breaking up of the bulk cargo is only very slight, it never the less starts or provides initial channels into the bulk cargo for the fluidizing air fluid to start the fluidization process which is expanded across the second floor interface with the bulk cargo as the fluidization system reaches full pressure.

DETAILED DESCRIPTION OF THE INVENTION

The flat built-in floor air-mattress like fluidizing device of this invention, is formed in at least two ways. One way is by adding a second floor panel to the liner floor, and inserting in between, in sandwich like manner several plastic mesh material strips of varying width, across a maximum surface area of the floor. Another way is creating a first and second floor with a sandwich like plastic mesh material strips included and the air-mattress like fluidizing device is firmly secured to the container floor against movement.

The plastic mesh strips are compartmentalized from each other by applying thermal sealing to both floor layers, in their entire length, encasing them therefore to form an air chamber about them. As each strip becomes insulated in these individual air chambers across the entire floor, each one of the air chambers can be injected by the fluid air individually, through an air hose, to maximize and create a uniform airbed effect in each of these individual air chambers across the entire floor that minimizes pneumatic pressure loss in any one chamber.

The air that is injected into the plastic mesh strip chambers by the air hose at each end of the strips, escapes into the interior chambers of the liner-bag in order to create the fluidization effect, by releasing the air through a multitude of pinholes or apertures on the top floor layer or second floor on top of the plastic mesh strips. The multitude of pinholes or apertures, which are located in varying density of number of pinholes or apertures and size of pinholes or apertures in relation to the pressure supplied, are to create substantially even pressure over the top layer or second floor and an even air fluid release over the surface of the second floor.

These holes or apertures can vary in number and density across the length of the strip chambers, but a typical configuration consists of a higher number density of pinholes or apertures towards the end of the strip chamber, the furthest end from the supply air hose, versus a lower number density of pinholes or apertures towards the beginning of the strip, the closest end to the air hose.

The purpose of such uneven distribution on the number density of the pinholes or apertures throughout the length of the strip chambers, is to provide the surface areas of the plastic mesh strip chambers the farthest from the air source with no significant air pressure loss, and therefore the fluidization effect stays uniform across all the liner-bag surface of the second floor layer.

The purpose of such uneven distribution of the size of the pinholes or apertures throughout the length of the strip chambers, is to provide the surface areas of the plastic mesh strip chambers the farthest front the air source with no significant air pressure loss, and therefore the fluidization effect stays uniform across all the liner-bag surface of the second floor layer.

Another way to address this issue would be to position the air injecting hose farther into the mesh strip chambers, but this setup is not as ideal, as the air hose then might pose a risk of being bent or pinched during the folding process when packing and unpacking the container.

This flat airbed system formed of individually air pressured air chambers, provides therefore a relative flat surface for the bulk cargo product to flow over unobstructed, but a more powerful fluidization effect due to the number of pinholes, and a more uniform fluidization effect due to the extensive distribution and varying size of those pinholes or apertures over the second floor, and thus much less risk than the non-airbed systems of being pinched or have their hoses bent and it also provides a very slight upward movement of the second floor against the bulk product to open it for initial fluid or air flow to start fluidization of the bulk cargo.

BRIEF DESCRIPTION OF THE DRAWINGS

The invention is herein described, by way of example only with reference to the accompanying drawings wherein the detailed descriptions are for the purpose of fully disclosing preferred embodiments of the invention without placing limitations thereon.

FIG. 1A also shows the maximum amount of movement upward of the foldable second floor layer when the chambers are supplied with air flow from its flat position laying against the foldable first floor layer, thus the fluidizing system is shown inflated in this FIG. 1A.

FIG. 1B also shows the maximum amount of movement upward of the foldable second floor layer when the chambers are supplied with air flow from its flat position laying against the foldable first floor layer thus the fluidized system is shown inflated in this FIG. 1B.

FIG. 1C also shows the maximum amount of movement upward of the foldable second floor layer when the chambers are supplied with air flow from its flat position laying against the foldable first floor layer, thus the fluidizing system is shown inflated in this FIG. 1C.

FIG. 1B-2 is a blown up portion of FIG. 1B to show how the fluidization works by passing fluid, such as air, through the sealed air chambers by delivery through the pin holes or apertures into the bulk commodity. FIG. 1B-2 also shows the maximum amount of movement upward of the foldable second floor layer when the chambers are supplied with air flow from its flat position laying against the foldable first floor layer, thus the fluidizing system is shown inflated in this FIG. 1B-2.

FIG. 1B-3 is a blown up portion of FIG. 1B to show the foldable second floor layer from its flat position laying against the foldable first floor layer when the chambers are not supplied with air flow, thus the fluidizing system is shown deflated in this FIG. 1B-3.

FIG. 2 is a top and side perspective view with the liner-bag shown in phantom lines and with a double layer floor formed by a first and second foldable floor layers with 3 rectangular shaped thermally sealed air chambers which have plastic mesh strips in the sealed air chambers and, with the top side or second floor layer perforated with fluidizing pinholes or apertures, at low, medium, and higher density of numbers and sizes of holes/apertures in the sealed air chambers.

FIG. 3 is a top view of the double layer floor formed by a first and second foldable floor layers with 7 rectangular thermally sealed air chambers with fluidizing pin holes in the top or second floor and inserted interwoven mesh strips in the 7 sealed air chambers to prevent bulk commodity product from closing off fluid flow in the 7 sealed air chambers from corresponding pneumatic injecting hoses and with manifolds created to distribute the air fluid between the 7 sealed air chambers.

DETAILED DESCRIPTIONS OF PREFERRED EMBODIMENTS OF THE INVENTION

Reference will now be made in detail to some of the present preferred embodiments which illustrate some of the concepts of this invention without limitation but to teach the broad concepts of this invention as applied.

Figure 1:
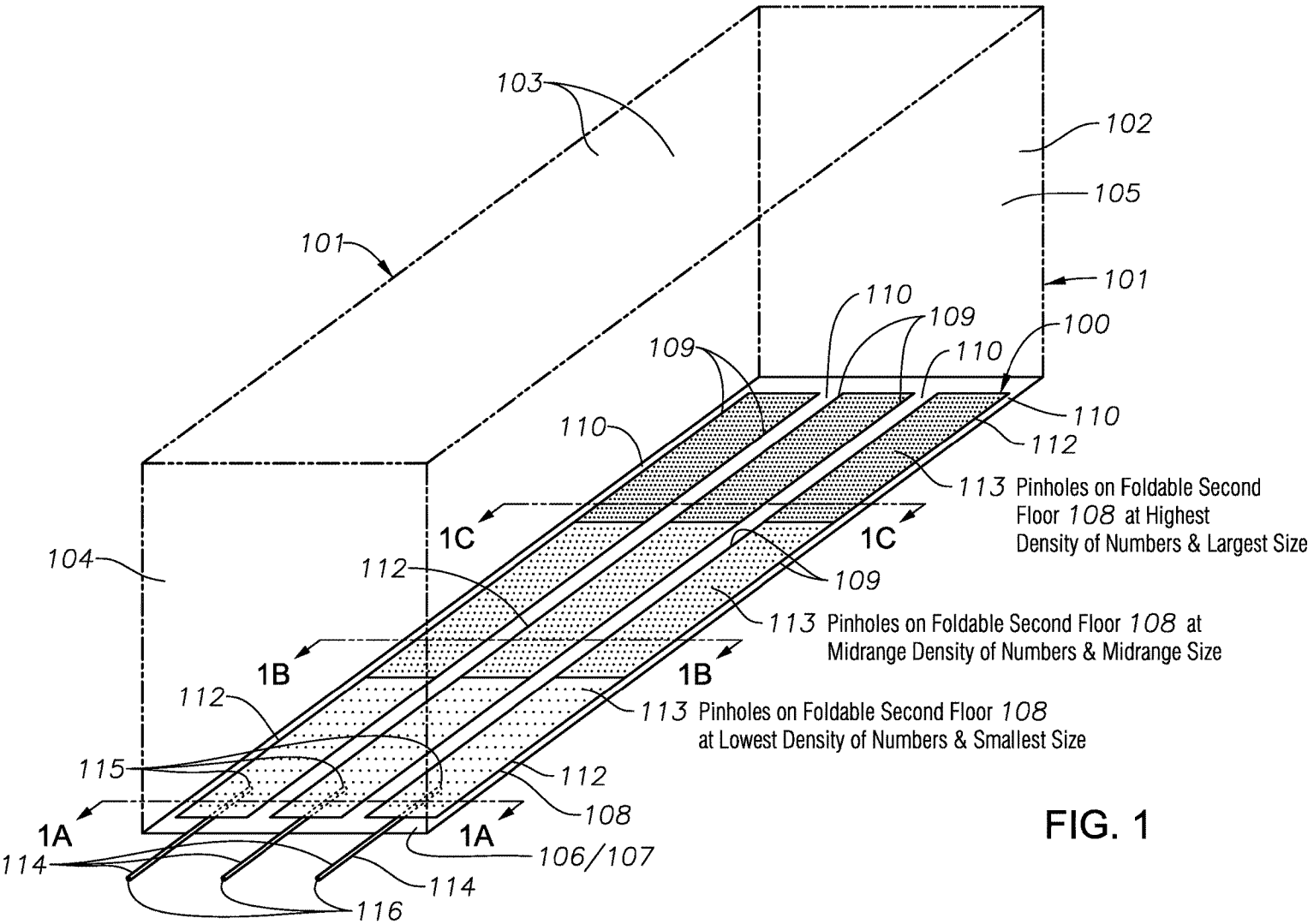
FIG. 1 is a top and side perspective view with the liner-bag shown in phantom lines and having a first and second floor which form a double layer floor with three rectangular shaped thermally sealed air chambers, with the top side or second floor perforated with fluidizing pinholes or apertures located in varying density of numbers and/or sizes over the air chambers and fed fluidizing fluid by hoses.

In the embodiment as shown in FIG. 1, the dry bulk commodities cargo fluidizing system 100 is shown positioned in a container shipping liner-bag 101 for receiving dry bulk commodities cargo, not shown. The shipping liner-bag 101 would be fitted in a shipping container, not shown. This shipping liner-bag 101 would fully line the shipping container for receiving a dry bulk commodity cargo for fully filling the container and container shipping liner-bag 101 to conform to the shape of the container and shipping liner-bag 101, as shown.

The shipping liner-bag 101, shown in FIG. 1, is composed generally of two side walls 102 and 103 shown outlined in phantom lines and generally has a front panel 104 which opens to allow full access to the shipping liner-bag 101 and aback wall 105 also shown outlined in phantom lines. In this embodiment, as shown, it generally has a floor 106 but this floor 106 may be incorporated into the dry bulk commodities cargo fluidizing system 100 as the foldable first floor layer 107 of the dry bulk commodities cargo fluidizing system 100 as will be further explained. The dry bulk commodities cargo fluidizing system 100 has a foldable first floor layer 107 and foldable second floor layer 108. The foldable first floor layer 107 of the dry bulk commodities cargo fluidizing system 100 may be incorporated into the floor of the shipping liner-bag 101 by using a foldable second floor layer 108 which is placed on top and thermally sealed to floor 106 of the shipping liner-bag 101 to form the foldable first floor layer 107 of the dry bulk commodities cargo fluidizing system 100, and will incorporate the inventive elements of this invention in it. It should be understood that in other embodiments that a separate first floor layer 107 could be used apart from the shipping liner-bag floor 106 without departing from the concept of this invention. In such an embodiment the foldable first floor layer 107 and foldable second floor layer 108 would be secured to the shipping liner-bag 101 and placed on the shipping liner-bag floor 106 of the shipping liner-bag 101 to prevent its movement. In this embodiment, shown in FIG. 1, the dry bulk commodities cargo fluidizing system 100 is thus shown positioned with a foldable first and second foldable floor layer 106, 107, and 108 to become part of the shipping container liner-bag 101. It should be understood however that in some embodiments that a separate floor could be used and the dry bulk commodities cargo fluidizing system 100 could be fitted into and secured to the shipping container liner-bag 101 against movement and still be covered by the concept of this invention.

In FIG. 1 the first and second foldable floors 106, 107, and 108 are joined together by forming thermal seals 109 for sealing selected sections 110 of the foldable first and second floor layer 107 and 108 together and leaving selected sections of the first and second foldable floors 107 and 108 unsealed to create chambers 112 for receiving and transferring fluid for fluidizing the commodities to be unloaded from the dry bulk commodities cargo fluidizing system 100 after reaching its destination. The fluid received into the chambers 112 to fluidize the bulk commodity cargo for unloading would puff up slightly the chambers 112 to push the bulk cargo upward to create cracks in the bulk cargo and then hold the chambers 112 up while the fluid is being discharged through the aperture members or pinholes 113 which are provided through the foldable second floor layer 108 to distribute the fluidizer into the dry bulk commodities which were loaded onto the foldable second floor 108. These aperture members or pinholes 113 are arranged by varying density of number of pinholes 113 and varying size of pinhole or aperture 113 relative to the varying pressure of the fluidizer or air put into the fluidizing system to even out the pressures over the whole foldable second floor layer 108 and provide relatively even discharge pressures through all the air pinholes or apertures 113 on the second foldable floor layer 108.

To better understand the purpose and use of the fluidizing system 100 one needs to understand the unloading process of bulk commodities from containers and shipping container liner-bags 101. After reaching its destination the container and container shipping liner-bags 101 with the bulk commodities would be unloaded. The unloading process would be commenced by opening the front panel 104 to allow full access to the contents of the liner-bag 101 and then the container would be tilted, up to 45' for example, to use gravity to unload the bulk commodities loaded into the container shipping liner-bags 101. To assist and enhance the gravitational effects of the flow of the bulk commodities at the 45' tilt, fluid flow, such as air, is started to flow into the bulk commodities in the container through the dry bulk commodities cargo fluidizing system 100 by passing fluidizer, such as air, through the aperture members or pinholes 113 at the varying densities of number and varying size pinholes or apertures over the chambers 112 to cause the 45 degree tilt to be more effective at pouring the bulk cargo out of the container without clumping up in the container.

The fluid for fluidizing the bulk commodities during unloading the bulk commodities is provided by at least one source member, which in FIG. 1 uses three such source members which are hoses 114 connected on one end 115 to the chambers 112 and inserted into the chambers 112 formed for receiving and delivering the fluid for fluidizing the dry bulk commodities. These source members or three hoses 114 are provided with connections on the other end 116 which are outside the chambers 112 to be connected to a fluidizing source, not shown, when the bulk commodities cargo is to be unloaded.

Figure 1A:
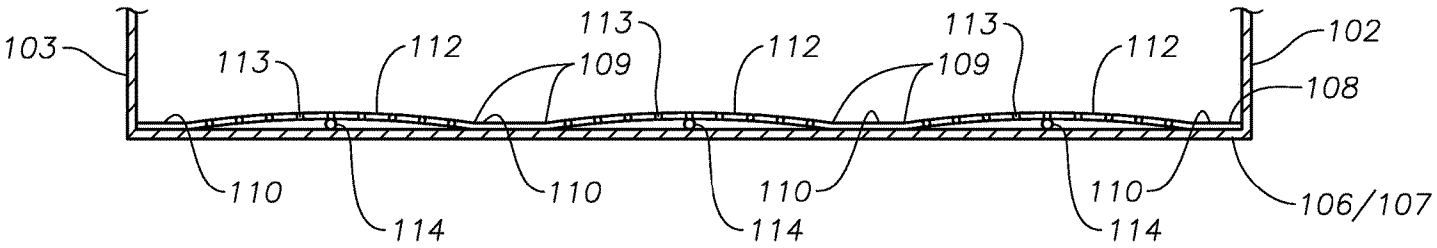
FIG. 1A, is a cross-section taken through FIG. 1 at 1A-1A to show the thermal seals which form chambers for fluid/air flow and hoses for supplying air flow to the chambers and out through the pin air holes or apertures in foldable second floor layer and to show the density of numbers and size of holes across the foldable second floor layer.
Figure 1B:
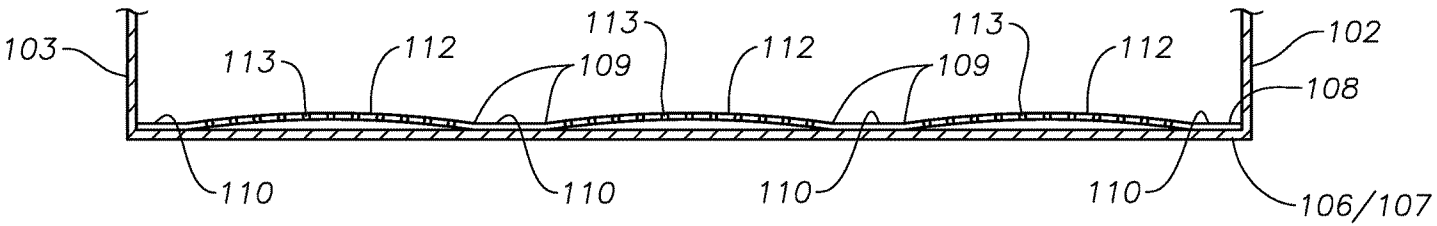
FIG. 1B, is a cross-section taken through FIG. 1 at 1B-1B to show the thermal seals which form chambers for fluid/air flow and to show the mid-range density of numbers and size of air holes or apertures across the foldable second floor layer.
Figure 1C:
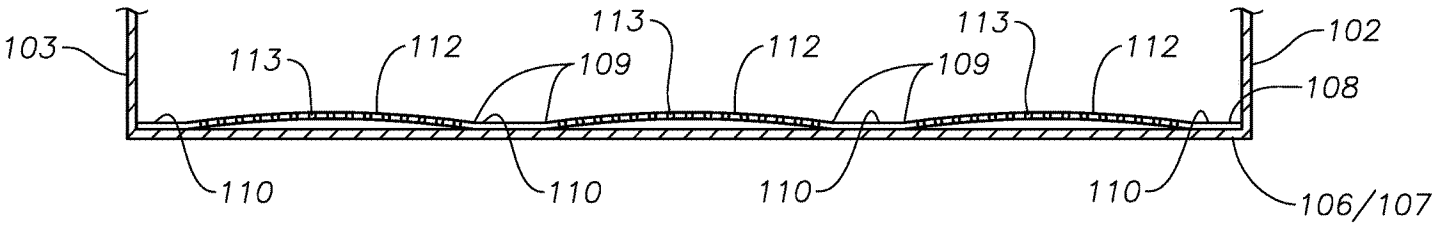
FIG. 1C, is a cross-section taken through FIG. 1 at 1C-1C to show the thermal seals which form chambers for fluid/air flow and to show the high range density of numbers and size of pin holes or apertures across the foldable second floor layer.
Figures 1, 1B, 2:
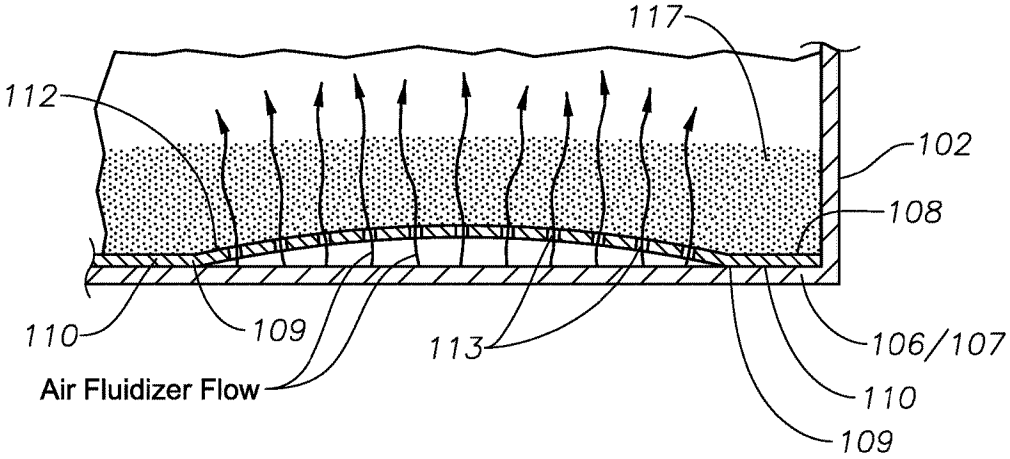

To aid in better understanding how fluidizing works in general and particularly how it is used in this invention reference should be made to FIGS. 1A, 1B, and 1C. FIGS. 1A, 1B, and 1C are cross-sections taken through FIG. 1 at 1A-1A, 1B-1B, and 1C-1C to show the functional structure of the FIG. 1 embodiment of dry bulk commodities cargo fluidizing system 100. FIG. 1B-2 is shown with a representation of bulk commodities 117 shown in magnification along with the magnification of a section of the cross-section of FIG. 1B-2 with fluidizing air flow which passes from the inflated chambers 112 through the apertures 113 into the bulk commodity to "fluidize" it. FIG. 1B-3 is shown with magnification without fluidizing air flow or in a deflated state with the chamber 112 formed between the foldable second floor 10B and the foldable first floor 106/107 against each other and the bulk commodity 117 on top.

Fluidization of dry bulk commodities, as can be seen FIG. 1B-2, is caused by the passing of a fluid, like air for example, through particles or pelletized substances to lubricate the surfaces or break the surfaces of the particles loose from their contact with each other to allow them to move more easily. In the case of dry bulk commodities, it allows and assists in unloading the dry bulk product when the container is tipped for unloading the dry bulk products from the container. A problem in the prior art at unloading has been the uneven and unequal distribution of the fluid through the dry bulk cargo which has then caused uneven fluidized dry bulk cargo to thus not slide smoothly out of the shipping liner-bag 101. If the cargo is improperly fluidized the cargo may cause the prior art fluidizing cargo equipment to be moved and cause it to block the unloading of the dry bulk cargo. It may also just create problems unloading the dry bulk cargo and leave a mess behind to be manually cleared. As can be seen in FIG. 1B-2 and FIG. 1B-3 and FIGS. 1A, 1B, and 1C the fluid/air is evenly spread over the foldable second floor layer 108 by the chambers 112 and through the apertures or pinholes 113 to the dry bulk cargo 117 while the foldable first floor layer 107 and foldable second floor layer 108 are securely held in the shipping liner-bag 101 and thus do not interfere with the dry bulk product being unloaded. However, the fluid/air as it begins to flow it does puff up slightly chambers 112 formed by the second floor layer 108. In these embodiments, the chambers 112 formed by the foldable second floor 108 push or move the dry bulk product slightly for breaking it loose to start or create channels in the bulk commodity 117 to receive the fluid/air flow into the bulk product 117 for starting the fluidizing of the bulk product 117 to allow it to slide out of the liner-bag 101 in unloading the container.

Further the fluid or air distribution in this invention is evenly distributed because of the configuration density and size of the apertures or pinholes 113 in relation to their distance from the location of the source connected on one end. 115 of the fluid or air supply hoses 114 to more evenly distribute the air or fluid over the whole second foldable floor layer 108 and in the chambers 112. This even distribution of the fluid or air over the second foldable floor layer 108 and in the chambers 112 is achieved by arranging the apertures or pinholes 113 to control the fluid pressure distribution over the second foldable floor layer 108 and in the chambers 112 both by pinhole 113 sizes and pinhole 113 density of location to evenly distribute the fluid.

The density of numbers and of size of the pinhole 113 used relative to their distance from the source of the fluid to the chambers 112 is used to provide even distribution of fluid in this invention. For example, by providing lowest number or density and smallest apertures or pinholes 113 through the second floor layer 108 nearest to the hose or hoses 114 discharge point 115, as shown in FIG. 1 and highest number or density and largest apertures or pinholes 113 located furthest from the hoses 114 at their discharge points of connection 115 the pressure is more evenly distributed. It will be further more evenly distributed by locating a mid-range of density or number and size of apertures or pinholes 113 being located between the highest and lowest density of number or size of pinholes 113 extremes for even fluid or air pressure distribution of the fluid or air.

A further novel feature of this invention is that the dry bulk commodities cargo fluidizing system 100 is foldable into the shipping container liner-bag 101 just as part of the dry bulk commodities cargo bags 101 and thus does not have to have a separate space for storing the bulk commodities cargo fluidizing system 100 apart from the dry bulk commodities shipping liner-bags 101. Also, if needed the dry bulk commodities shipping liner-bags 101 can be used as a regular shipping liner-bag because the dry bulk commodities shipping liner-bags 101 would not take up or interfere with the liner-bags 101 if it was needed for other uses than bulk commodities. However, in some embodiments it can be a separate system which can be installed into a shipping container liner-bag 101 and used to allow a general shipping container liner-bag 101 to become a dry bulk commodities cargo shipping, container providing bulk commodities cargo fluidizing system 100 can be secured to the floor of the container bag against movement in the container bag, especially in tilting discharge of bulk commodities.

In yet other embodiments of the dry bulk commodities fluidizing system 100 as shown in FIG. 2 there can be provided interface members between the first and second foldable floor layers 107 and 108 which can take many forms, but one such form is plastic mesh strips 119 which are just as foldable as the foldable first and second floor 107 and 108. These plastic mesh strips 119 which are positioned in the chambers 112 formed between the first and second foldable floor layers 107 and 108 are for preventing dry bulk commodities on top of the second foldable floor layer 108 from sealing off fluid flow of fluidizing fluid between the first and second foldable floor layers 107 and 108 when the commodities are loaded into the shipping liner-bag 101 of the shipping container. Thus when it is time to unload dry bulk commodities these plastic mesh strips 119 prevent the sealing off of fluid flow between the first and second foldable floor layers 107 and 108 when the fluid or air is injected into the hose or hoses 114 for receiving and delivering the fluid for fluidizing the dry bulk commodities after transit and when it is time to unload the dry bulk commodities. These plastic mesh strips 119 provide air or fluid passageways for flow even when the first and second foldable floors 107 and 108 are pressed together by the forces of the dry bulk commodities loaded into the shipping liner-bag 101.

Figures 1, 1B, 2, 3:
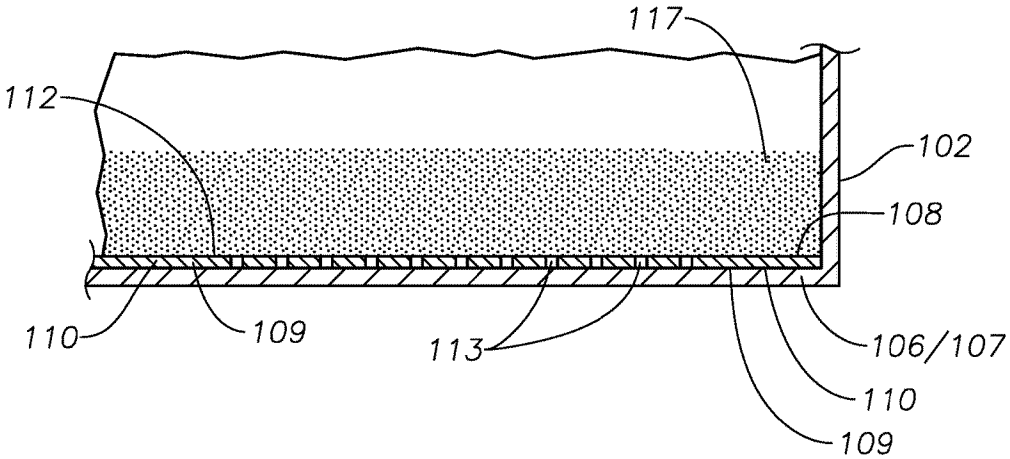
Figure 2:
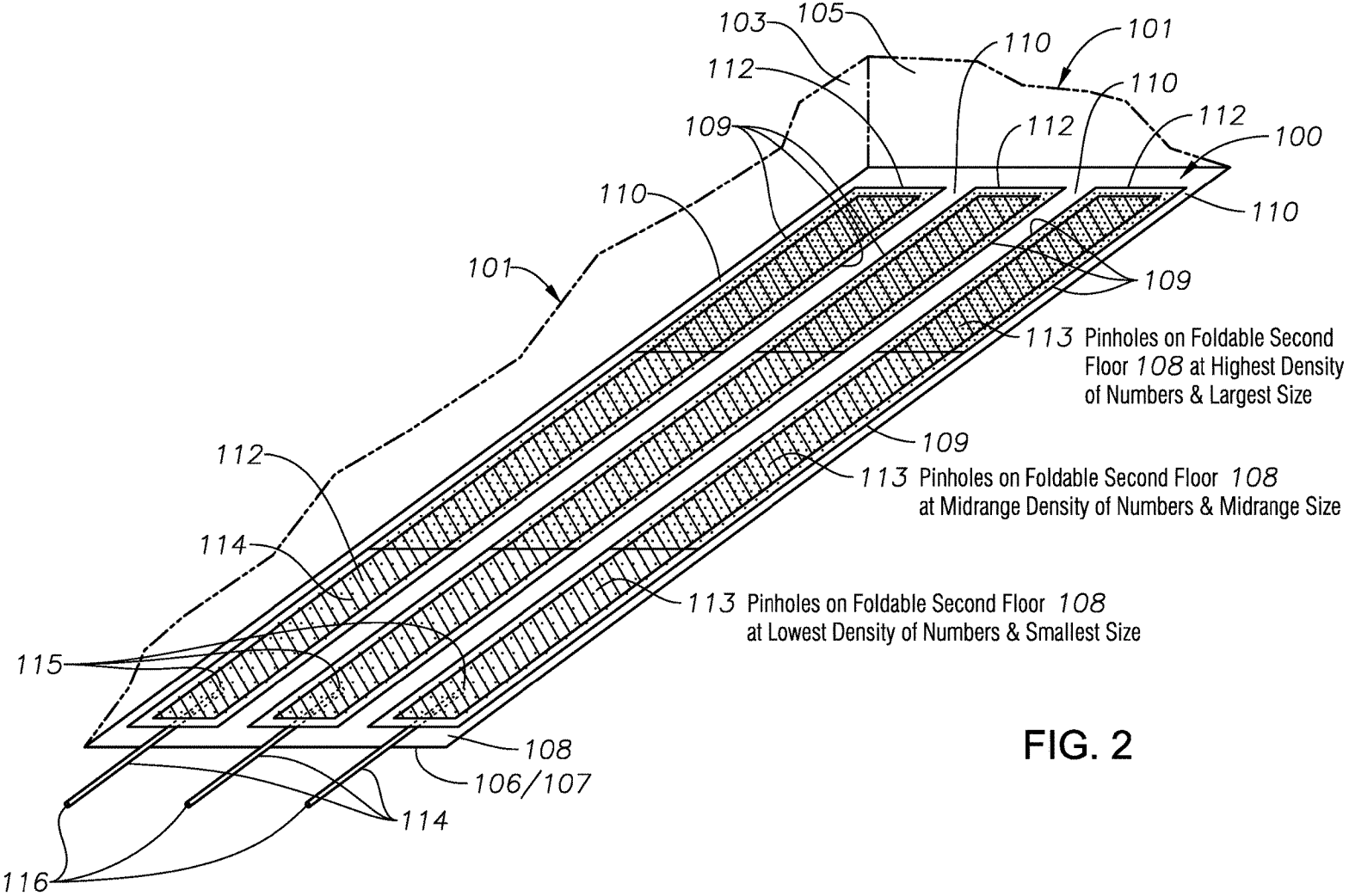

In yet other embodiments of the dry bulk commodities fluidizing system 100 as shown in FIG. 3 there can be provided a mixture of interface means and chambers and cross woven plastic strips or sheets 120 used to provide interface members between the first and second foldable floor layers 107 and 108 for preventing the bulk commodities placed on top of the second foldable floor layer 108 from sealing off fluid flow between the first and second foldable floor layers 107 and 108 when the commodities are loaded into the container liner-bag 101 of a shipping container. These mixtures of interface members are integrated for varying conditions which may be found to occur in dry bulk commodities after shipping them and based on the properties of the dry bulk commodities shipped.

Figure 3:
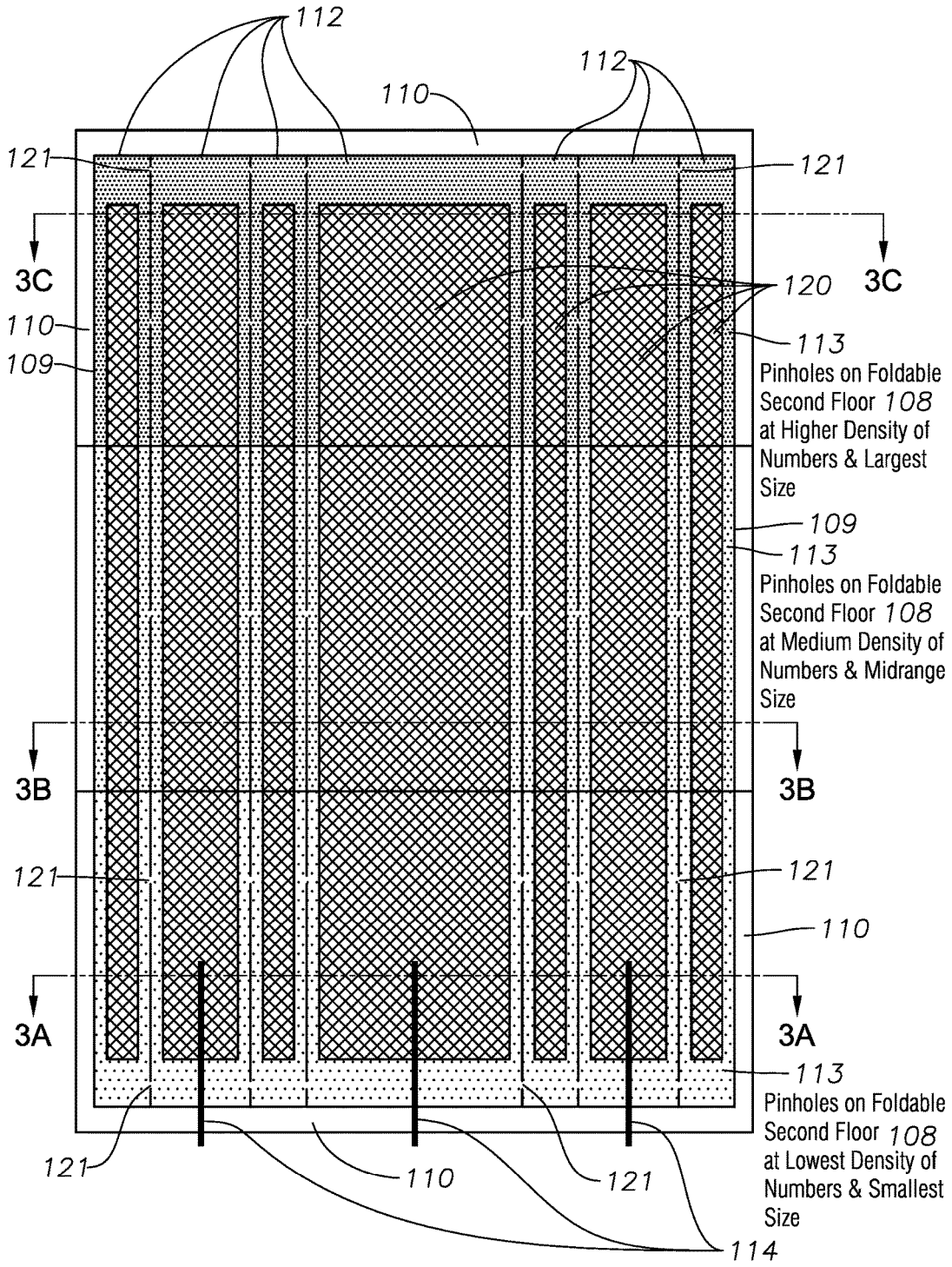
Figure 3A:
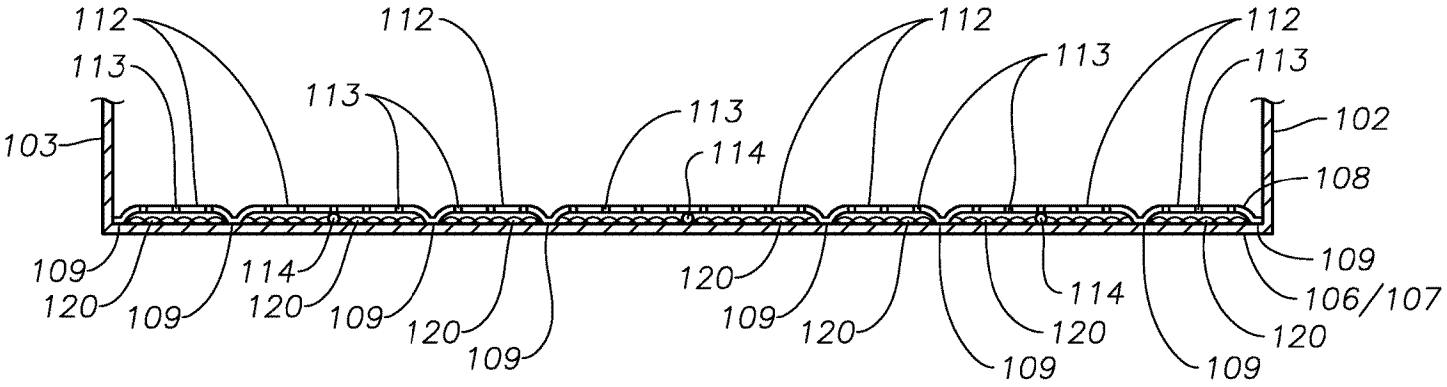
FIG. 3A, is a cross-section taken through FIG. 3 at 3A-3A to show the thermal seals which form chambers for fluid/air flow and hoses for supplying air flow to the chambers and out through the air pin holes or apertures in the foldable second floor layer and to show the density of numbers and size of holes across the foldable second floor layer when the chambers are supplied with air flow, thus the fluidizing system is shown inflated in this FIG. 3A.
Figure 3B:
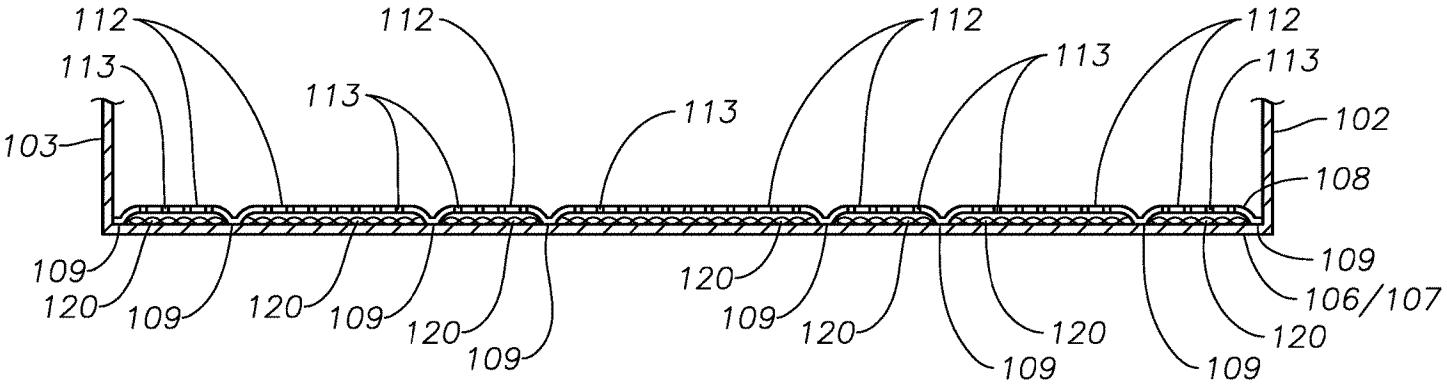
FIG. 3B, is a cross-section taken through FIG. 3 at 3B-3B to show the thermal seals which form chambers for fluid/air flow for supplying air flow to the chambers and out through the air holes or apertures in foldable second floor layer and to show the density of numbers and size of holes across the foldable second floor layer, thus the fluidizing system is shown inflated in this FIG. 3B.
Figure 3C:
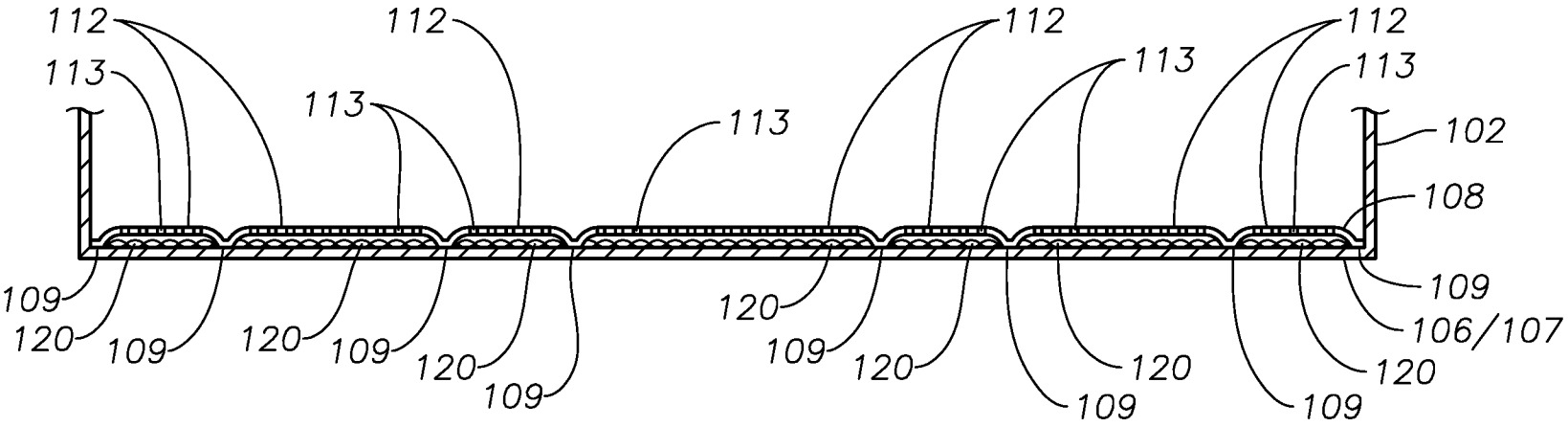
FIG. 3C, is a cross-section taken through FIG. 3 at 3C-3C to show the thermal seals which form chambers for fluid/air flow for supplying air flow to the chambers and out through the air holes or apertures in foldable second floor layer and to show the density of number and size of holes across the foldable second floor layer, thus the fluidizing system is shown inflated in this FIG. 3C.
Figure 4:
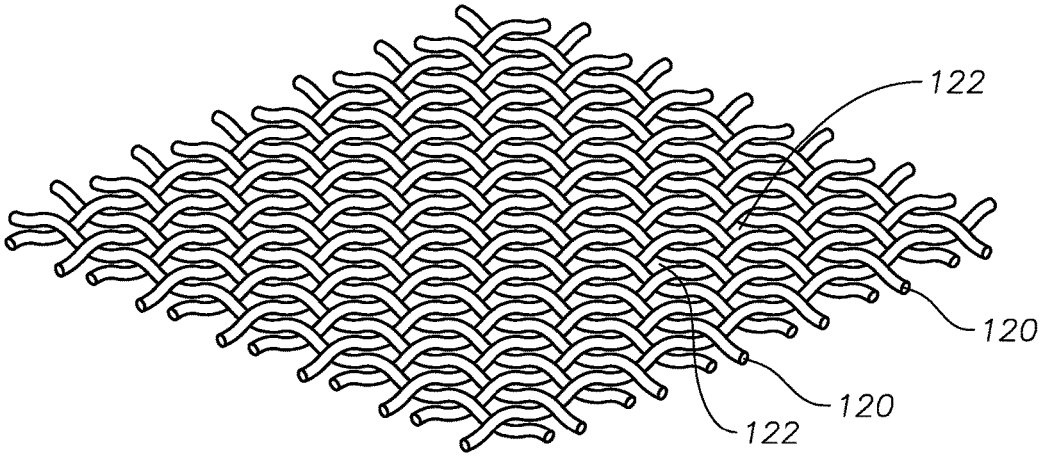
FIG. 4 is a top view in detail of at least a part of one form of interface made of interwoven plastic mesh which shows the plastic mesh which provides "bridge air passage" between the first and second floor layers used to keep the fluid air flowing even when the commodity is loaded onto the second floor of the container liner.
Figure 4A:
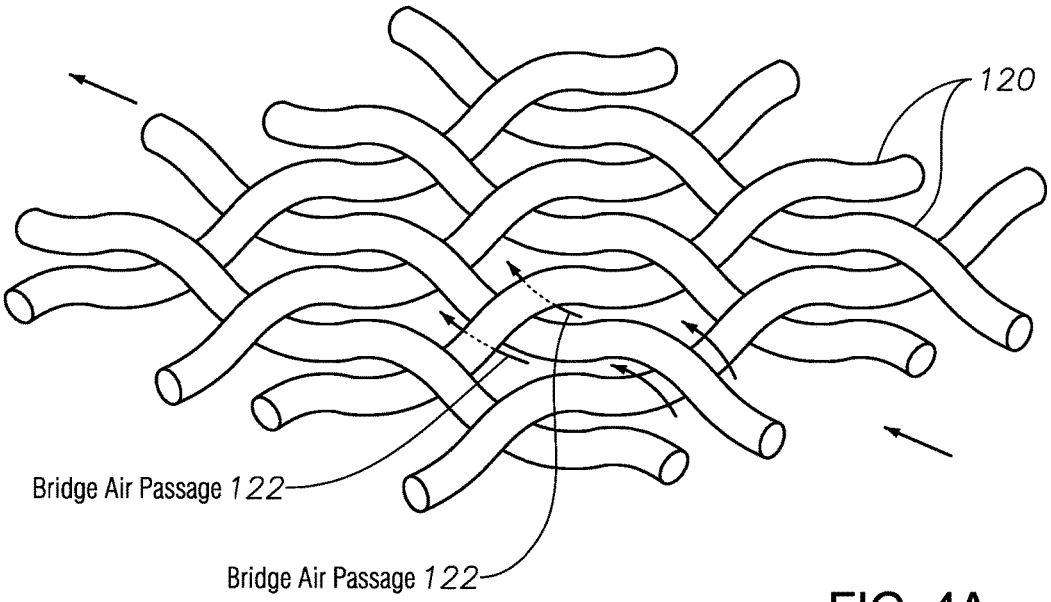
FIG. 4A is a magnified top view of the interwoven plastic mesh which shows the plastic mesh in detail and delimitates a section of the plastic mesh detailed as "bridge air passage" for further magnification of "bridge air passage" detail to show the "air passages" in the interwoven plastic mesh which would keep fluid air flowing even when the commodity is loaded onto the second floor of the container liner.

For example, in FIG. 3 and FIG. 4 and cross-sections FIGS. 3A, 3B and 3C there are provided chambers 112 which have cross woven plastic strips 120 which are placed and located in seven chambers 112. These seven chambers 112 are created by thermal seals 109 but the cross woven plastic sheets 120 are formed in strips and do not cover the entire chamber 112 and leave portions of the chambers 112 to act as interconnected manifolds 121 for the distribution of the fluid or air freely through and between the chambers 112 and through apertures or pinholes 113 thus providing multiple conditions at varied locations under which fluid, or air is passed through the apertures or pinholes 113. Thus this dry bulk commodity cargo fluidizing system 100 may start fluidizing from the sections with the seven chambers 112 from the areas where the cross woven plastic strips 120 are located because the fluid or air may pass about the bridge air passages 122 and as the fluidizing progresses to the areas with apertures or pinholes 113 in the chambers 112 without cross-woven plastic sheets 120 may start to flow fluid or air to advance the fluidizing process of the dry bulk commodities. Also, in some embodiments the second flexible floor layer 108 which forms the top of chambers 112 are allowed to move outward against the bulk commodity on top of second floor layer 108 which causes the bulk commodity 117 to move and break up for creating new channels in the bulk commodity 117 for receiving the fluid/air for enhancing the fluidizing effect.

The apertures or pinholes 113 even as shown in FIG. 3 are arranged in lowest density of numbers and smallest sizes nearest the discharge point 115 of hoses 114 and highest density of numbers and largest size apertures/pinholes 113 furthest from the discharge point 115 of the hoses 114 and with medium density and medium size of apertures or pinholes 113 between the lowest density and smallest size and the highest density and largest size pinholes 113 for providing an evenly distributed fluid or air flow through all the apertures or pinholes 113 over the entire surface of the foldable second floor layer 108 of the fluidizing system for dry bulk commodity cargo.

Also by controlling the chamber 112 sizes and the open cross section area sizes between the first and second floors 107 and 108 at the thermal seals 109 across the first and second floors 107 and 108 and the woven mesh strips 120, provides even control of the fluidizing fluid or air pressure while allowing slight movement upward of the foldable second floor layer 108 which forms the top of the chambers 112 to provide some mechanical shock to the bulk commodities to allow the fluidizing fluid or air to start its penetration of the bulk commodities.

Further by varying the size of the chamber 112 and the surface area where the cross woven plastic sheets 120 are used the fluid or air may be less blocked at the first phase of fluidizing and as it progresses more of the foldable second floor layer used will then be activated to flow fluid or air through the foldable second floor layer 108.

In view of the foregoing, it is intended that the present invention cover modifications and variations of this invention, provided they fall within the scope of the following claims and their equivalent.

The invention claimed is:

1. A dry bulk commodities cargo fluidizing system for fluidizing bulk commodities having multiple chambers with different fluid flowing properties which are substantially flat, foldable and expandable upward against the bulk commodities by fluid for initially opening said commodities for receiving fluid flow and for delivering fluid into said bulk commodities for use in shipping container liner-bags used for transporting bulk commodities comprising:

a. a foldable first floor layer;

b. a foldable and flexible upward expandable second floor layer for receiving said bulk commodity placed thereon and for covering said first floor layer and for forming multiple chambers with different fluid flowing properties by being sealed with said first floor layer to allow fluid flow between said first and second floor layers and leaving said second floor layer expandable upward against said bulk commodity for opening said bulk commodity for receiving fluid flow into said bulk commodity;

c. at least one source member having a receiving point and delivery point for said fluid for fluidizing said commodities connected to said chambers formed between said first and second floor layers for delivery of said fluid to said multiple chambers;

d. aperture means formed through said foldable and flexible second floor layer of various sizes and located in various density of numbers over said foldable and flexible second floor layer relative to said aperture means distances from said delivery point of said at least one source member for causing said multiple chambers of said second floor layer to expand upward against said bulk commodity for opening said bulk commodity for receiving fluid flow and to transfer fluidizing fluid evenly over said foldable second floor layer by passing fluid through said aperture means for fluidizing said dry bulk commodities loaded on said foldable and flexible second floor layer; and f. foldable interface means placed on said foldable first floor layer in said various chambers for allowing fluid flow and timing differences for upward movement of said foldable and flexible second floor layer and for preventing said commodities on top of said foldable and flexible second floor layer from sealing off fluid flow between said first foldable floor layer and foldable and flexible second floor layer when said commodities have been loaded into said container liner-bag of said shipping container.

2. A dry bulk commodities cargo fluidizing system for fluidizing bulk commodities of claim 1 wherein said aperture means formed through said second floor layer of various sizes and located in various density of numbers over said foldable and flexible second floor layer relative to said aperture means distances from said delivery point of said at least one source member further comprises;

a. aperture means being located with the least dense number and the smallest size of aperture means through said foldable and flexible second floor layer for aperture means located closest to said at least one source member for delivering said fluid for fluidizing said dry bulk commodities; and b. aperture means being located with the most dense number and the largest size of aperture means through said foldable and flexible second floor layer for aperture means located farthest from said at least one source member for delivering said fluid for fluidizing said dry bulk commodities.

3. The dry bulk commodities cargo fluidizing system for fluidizing bulk commodities of claim 2 wherein said foldable interface means placed on said foldable first floor layer in said various chambers between said first and second floor layers for allowing fluid flow and timing differences for upward movement of said foldable and flexible second floor layer and for preventing said commodities on top of said foldable and flexible second floor layer from sealing off fluid flow between said foldable first floor layer and foldable and flexible second floor layer when said commodities have been loaded into said container liner-bag of said shipping container further comprising;

a. flexible and foldable mesh strips placed flat on said foldable first floor layer between said first and second floor layers for allowing controlled fluid flow between said foldable mesh strips and said chambers created between said first and second floors layers when said commodities are loaded on said second floor layer in said liner bag of said shipping container.

4. The dry bulk commodities cargo fluidizing system for fluidizing bulk commodities of claim 3 wherein flexible and foldable mesh strips between said first and second floor layers further comprises;

a. flexible and foldable inter-woven mesh strips placed flat on said foldable first floor layer between said first and second floor layers for allowing fluid flow between said inter-woven foldable mesh strips and said chambers created between said first and second floors layers when said commodities are loaded on second floor layer in said liner bag of said shipping container.

5. A dry bulk commodities cargo fluidizing system for fluidizing bulk commodities of claim 4 wherein said aperture means formed through said second floor layer being located with said least dense number and smallest sizes of aperture means through said foldable and flexible second floor layer located closest to said at least one source member for delivering said fluid and with said most dense in number and largest size of aperture means through said foldable and flexible second floor layer for aperture means located farthest from said at least one source member for delivering said fluid through said second floor layer further comprises;

a. aperture means formed through said second floor layer being located in a midrange density of numbers and midrange of aperture sizes between said aperture means arranged from said least dense number and smallest sized aperture means and to said most dense numbers and largest sized aperture means for delivering said fluid for fluidizing said dry bulk commodities.

6. The dry bulk commodities cargo fluidizing, system for fluidizing bulk commodities of claim 5 further comprising;

a. manifold means formed by sealing selected sections of said foldable first floor layer and foldable and flexible second floor layer together and leaving selected sections of said foldable first and foldable and flexible second floor layers unsealed between said chambers formed for fluid communication between said chambers for distribution of fluidizing fluid relatively evenly for fluidizing said dry bulk commodities in said shipping container.

7. The dry bulk commodities cargo fluidizing system for fluidizing bulk commodities of claim 6 further comprising;

a. a system volume and cross-sectional area of said chambers and said manifolds formed between said foldable first floor layer and said foldable and flexible second floor layer and with said chambers and with said number of aperture means and said size of aperture means for providing substantially even distribution of fluid over said foldable and flexible second floor layer for said expansion of said second floor layer upward against said bulk commodity for opening said bulk commodity and for leaving a sufficient flow of fluid for receiving fluid flow into said bulk commodity and for creating said fluidizing pressure sufficient for evenly fluidizing said dry bulk commodities cargo in said shipping containers.

8. The dry bulk commodities cargo fluidizing system for fluidizing bulk commodities of claim 7 wherein said chambers formed between said foldable first floor layer and foldable and flexible second floor layers for receiving and transferring fluid for fluidizing said commodities loaded into said liner bags of said shipping containers further comprises;

a. one to eight chambers formed between said foldable first floor layer and foldable and flexible second floor layers which run the length of said shipping container.

9. The dry bulk commodities cargo fluidizing system for fluidizing bulk commodities of claim 8 wherein said at least one source member having a receiving point and delivery point for said fluid for fluidizing said commodities connected to said chambers formed between said foldable first floor layer and said foldable and flexible second floor layer for delivery of said fluid to said multiples chambers further comprises;

a. One to six source members connected to said chambers at one end of said shipping container for receiving fluid and for distributing fluid to said chambers for fluidizing said commodities.

10. The dry bulk commodities cargo fluidizing system for fluidizing bulk commodities of claim 9 wherein said one to six source members connected to said chambers at one end of said shipping container further comprises;

a. One to six source hoses connected to said chambers at one end of said shipping container for receiving fluid and for distributing fluid to said chambers for fluidizing said commodities.

11. The dry bulk commodities cargo fluidizing system for fluidizing bulk commodities of claim 10 wherein said foldable first floor layer further comprises;

a. a foldable first floor which is said foldable first floor of said bulk shipping container liner bag used for transporting bulk commodities and said foldable and flexible upward expandable second floor layer for receiving said bulk commodity being placed thereon and for covering said foldable first floor of said bulk shipping container liner bag floor is joined and sealed with said bulk shipping container foldable liner bag floor to allow fluid flow between said foldable first floor of said bulk shipping container and said foldable and flexible second floor layer for forming multiple chambers with different fluid flowing properties to allow fluid flow between and leaving said second floor layer expandable upward against said bulk commodity for opening said bulk commodity for receiving fluid flow into said bulk commodity.

* * * * *